US010810830B2

(12) United States Patent
Lamb et al.

(10) Patent No.: US 10,810,830 B2
(45) **Date of Patent: *Oct. 20, 2020**

(54) GAMING DEVICES WITH SYMBOL BLOCKING AND RESPIN FEATURE

(71) Applicant: KING SHOW GAMES, INC., Minnetonka, MN (US)

(72) Inventors: Jacob Lamb, Maple Grove, MN (US); Adam Koshorek, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/281,215

(22) Filed: Feb. 21, 2019

(65) Prior Publication Data

US 2019/0188950 A1 Jun. 20, 2019

Related U.S. Application Data

(63) Continuation of application No. 15/807,384, filed on Nov. 8, 2017, now Pat. No. 10,217,316.

(60) Provisional application No. 62/419,432, filed on Nov. 8, 2016.

(51) Int. Cl.
*G07F 17/32* (2006.01)
*G07F 17/34* (2006.01)

(52) U.S. Cl.
CPC ..... *G07F 17/3213* (2013.01); *G07F 17/3244* (2013.01); *G07F 17/34* (2013.01)

(58) Field of Classification Search
USPC ..... 463/20
See application file for complete search history.

(56) References Cited

U.S. PATENT DOCUMENTS

| | | | | |
|---|---|---|---|---|
| 7,070,502 | B1 | 7/2006 | Bussick et al. | |
| 7,175,523 | B2 | 2/2007 | Gilmore et al. | |
| 7,195,559 | B2 | 3/2007 | Gilmore et al. | |
| 8,021,226 | B2 | 9/2011 | Souza et al. | |
| 8,366,533 | B1 | 2/2013 | Nicely | |
| 8,512,127 | B2 | 8/2013 | Jaffe et al. | |
| 8,734,223 | B2 | 5/2014 | Zoble et al. | |
| 9,773,369 | B2 * | 9/2017 | Berman | G07F 17/34 |
| 2006/0205469 | A1 | 9/2006 | Schultz et al. | |
| 2006/0264254 | A1 | 11/2006 | Aoki | |
| 2010/0004048 | A1 | 1/2010 | Brito | |
| 2012/0034969 | A1 | 2/2012 | Singer et al. | |
| 2013/0184050 | A1 | 7/2013 | Zoble et al. | |
| 2013/0190066 | A1 | 7/2013 | Saunders | |
| 2013/0260863 | A1 | 10/2013 | Lee et al. | |

(Continued)

*Primary Examiner* — Pierre E Elisca

(57) ABSTRACT

Embodiments of the present invention set forth systems, apparatuses and methods for providing a symbol blocking and respin feature. Accordingly, a gaming device can be configured to receive a first game initiation signal and spin reels on the display to show a first game outcome. The gaming device then determines if the results of the first game outcome are associated with a multi-reel symbol trigger condition. When it is determined that the trigger condition is satisfied, a multi-reel symbol is formed from symbols associated with the triggering condition by locking the symbols together. The game device then spins a reel with in the block symbol location with various modifier subsymbols, or other block symbols, to provide additional award opportunities. A second game outcome may be determined when the spinning block reel stops and any modifiers or other symbols are evaluated with the other symbols on the game grid.

20 Claims, 23 Drawing Sheets

(56) References Cited

U.S. PATENT DOCUMENTS

| | | | | |
|---|---|---|---|---|
| 2015/0170462 | A1* | 6/2015 | Berman | G07F 17/3213 463/20 |
| 2018/0018854 | A1* | 1/2018 | Berman | G07F 17/3213 |

* cited by examiner

GAMING DEVICES WITH SYMBOL BLOCKING AND RESPIN FEATURE

RELATED APPLICATIONS

This application is a continuation of U.S. application Ser. No. 15/807,384, filed Nov. 8, 2017, now U.S. Pat. No. 10,217,316, which claims the benefit of Provisional Patent Application No. 62/419,432, filed on Nov. 8, 2016, to which priority is claimed pursuant to 35 U.S.C. § 119(e) and which is incorporated herein by reference in its entirety.

FIELD OF THE INVENTION

This disclosure relates generally to games, and more particularly to systems, apparatuses and methods for providing symbol blocking and respin features on gaming devices.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming" As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes methods, systems, and apparatus that provide for new and interesting gaming experiences, and that provide other advantages over the prior art.

SUMMARY

To overcome limitations in the prior art described above, and to overcome other limitations that will become apparent upon reading and understanding the present specification, embodiments of the present invention are directed to an apparatus, system, computer readable storage media, and/or method that involve or otherwise provide symbol blocking and respin features on gaming devices. Accordingly, a gaming device can be configured to receive a first game initiation signal and spin reels on the display to show a first game outcome. The gaming device then determines if the results of the first game outcome are associated with a multi-reel symbol trigger condition. When it is determined that the trigger condition is satisfied, a multi-reel symbol is formed from symbols associated with the triggering condition by locking the symbols together. The game device then spins a reel with in the block symbol location with various modifier subsymbols, or other block symbols, to provide additional award opportunities. A second game outcome may be determined when the spinning block reel stops and any modifiers or other symbols are evaluated with the other symbols on the game grid.

In one embodiment, a gaming device includes a display, a player interface, and a processor. The processor may be configured to receive a first game initiation signal and spin reels on the display to show a first game outcome. The processor may further be configured to determine if the results of the first game outcome is associated with a multi-reel symbol trigger condition. When it is determined that the trigger condition is satisfied, the processor is further configured to form a multi-reel symbol from symbols associated with the triggering condition and spin a reel within the block. Symbols in the block reel may be the same as the originally formed block symbol with modifiers, or may be other valuable symbols such as wild symbols or bonus symbols. The processor is further configured to stop the block reel from spinning and evaluating a second game outcome based on the result of the block reel and previous symbols on the symbol grid. The processor may then be configured to determine prizes associated with the second game outcome.

DETAILED DESCRIPTION

Figure 1:
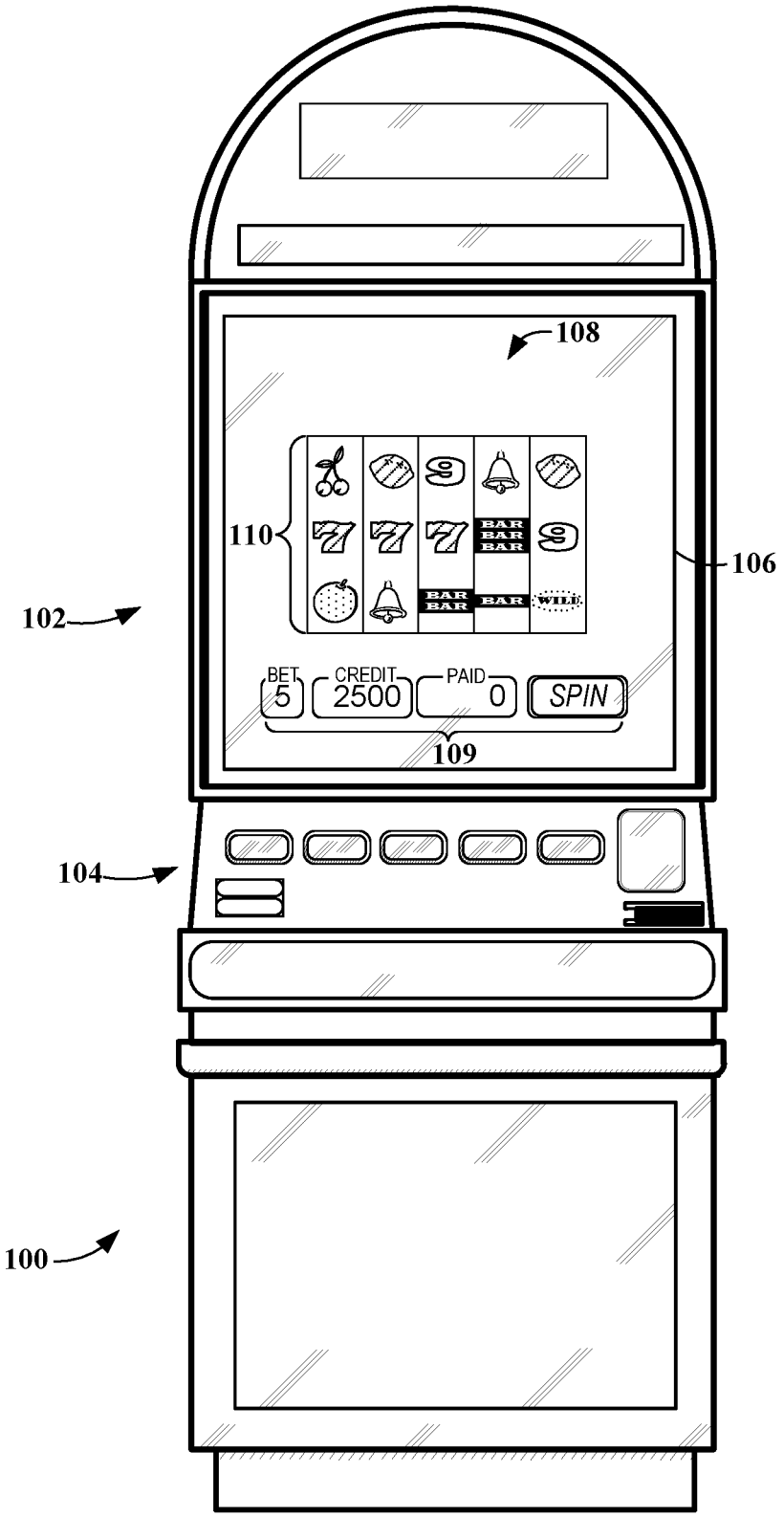
FIG. 1 is a diagram of a gaming machine according to embodiments of the invention.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatus.

In various embodiments of the invention, the gaming displays are described in conjunction with the use of data in the form of "symbols." In the context of this disclosure, a "symbol" may generally refer at least to a collection of one or more arbitrary indicia or signs that have some conventional significance. In particular, the symbol represents values that can at least be used to determine whether to award a payout. A symbol may include numbers, letters, shapes, pictures, textures, colors, sounds, etc., and any combination therebetween. A win can be determined by comparing the symbol with another symbol. Generally, such comparisons can be performed via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for providing symbol blocking and respin features in gaming activities. The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity.

Embodiments of the present concept include providing gaming devices (also referred to as gaming apparatuses or gaming machines), gaming systems, and methods of operating these devices or systems to provide game play that utilizes operations of providing symbol blocking and respin features on gaming devices. In one embodiment, a method of operating a gaming device includes determining if a jumbo symbol that fills a plurality of reel strips completely, and generating a jumbo reel when the jumbo symbol fills the plurality of reel strips. This jumbo reel may be filled with the symbol that originated the win, where each symbol is associated with a different subsymbol, or may be populated with other high value symbols. The jumbo reel may then be spun and the results of the jumbo reel spin shown on the game display. Here, the subsymbol feature may be applied to the reels, such as a random multiplier, extend left, extend right, extend up, etc., or the high value symbols may be evaluated with the other symbols on the game grid from the first gaming event outcome.

Numerous variations are possible using these and other embodiments of the inventive concept. Some of these embodiments and variations are discussed below with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, or other games of chance. Some of these other types of embodiments will be discussed below as variations to the examples illustrated. However, many other types of games can implement similar techniques and fall within the scope of this inventive concept.

Referring to the example gaming apparatus 100 shown in FIG. 1, the gaming apparatus includes a display area 102 (also referred to as a gaming display), and a player interface area 104, although some or all of the interactive mechanisms included in the user interface area 104 may be provided via graphical icons used with a touch screen in the display area 102 in some embodiments. The display area 102 may include one or more game displays 106 (also referred to as "displays" or "gaming displays") that may be included in physically separate displays or as portions of a common large display. Here, the game display 106 includes a primary game play portion 108 that displays game elements and symbols 110, and an operations portion 109 that can include meters, various game buttons, or other game information for a player of the gaming device 100.

The user interface 104 allows the user to control and engage in play of the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, or any other user input system or mechanism that allows the user to play the particular gaming activity.

The user interface 104 may allow the user or player to enter coins, bills, or otherwise obtain credits through vouchers, tokens, credit cards, tickets, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player loyalty information to identify a user or player of the gaming device. This mechanism may be card reader, biometric scanner, keypad, or other input device. It is through the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touchscreen, entering text, entering voice commands, or other known data entry methodology.

The game display 106 in the display area 102 may include one or more of an electronic display, a video display, a mechanical display, and fixed display information, such as paytable information associated with a glass/plastic panel on the gaming machine 100 and/or graphical images. The symbols or other indicia associated with the play of the game may be presented on an electronic display device or on mechanical devices associated with a mechanical display. Generally, the display 106 devotes the largest portion of viewable area to the primary gaming portion 108. The primary gaming portion 108 is generally where the visual feedback for any selected game is provided to the user. The primary gaming portion 108 may render graphical objects such as cards, slot reels, dice, animated characters, and any other gaming visual known in the art. The primary gaming portion 108 also typically informs players of the outcome of any particular event, including whether the event resulted in a win or loss.

In some the example embodiments illustrated herein, the primary gaming portion 108 may display a grid (or equivalent arrangement) of game elements 110 or game element positions (also referred to as "reel stop positions" herein). As illustrated in the embodiment shown in FIG. 1, the grid includes three rows and five columns of game elements 110, which may form a game outcome of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as paytables, navigation controls, etc.

Figure 2:
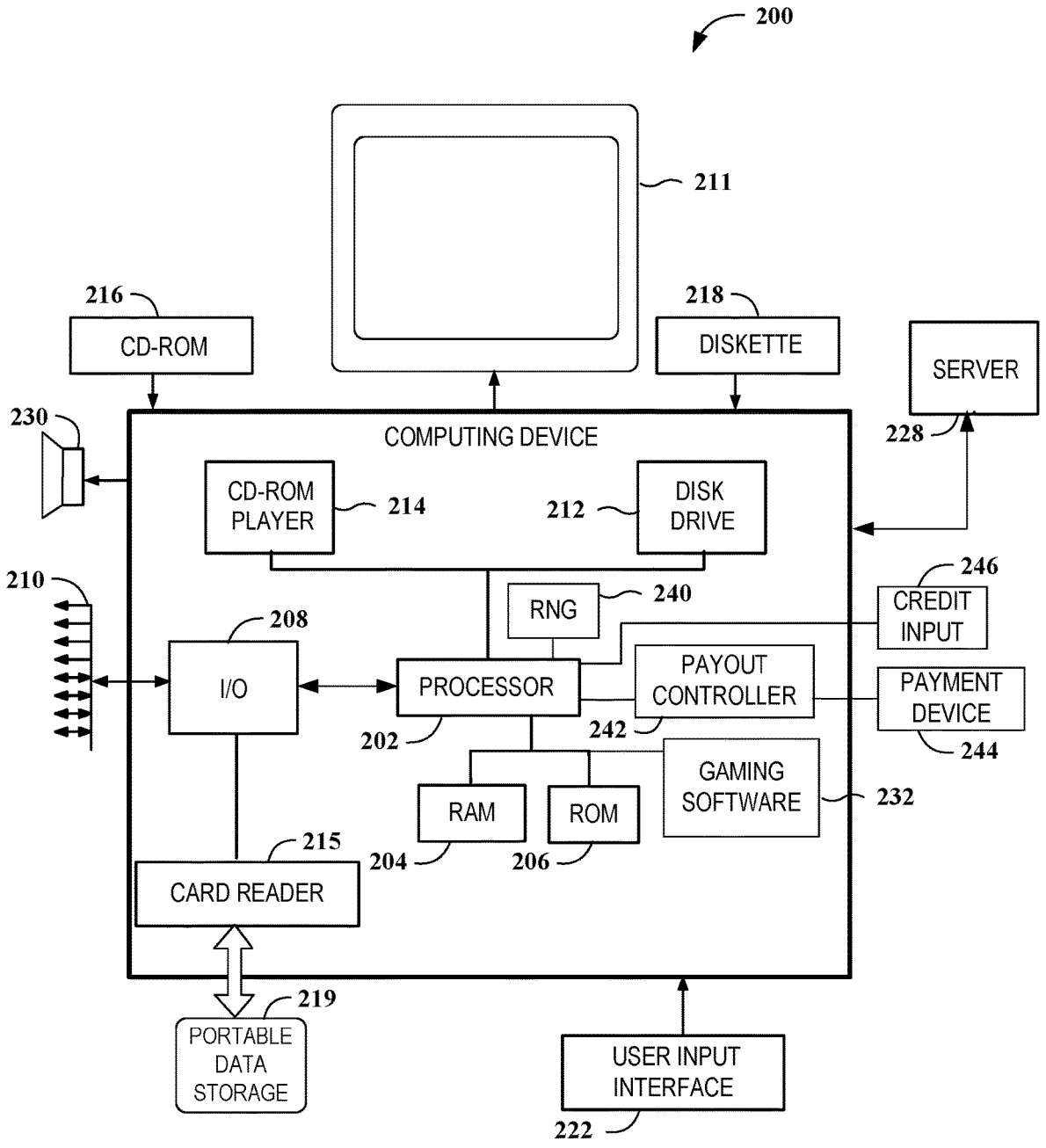
FIG. 2 is a block diagram illustrating a computing arrangement according to embodiments of the invention.

Although FIG. 1 illustrates a particular implementation of some of the embodiments of this invention in a casino or electronic gaming machine ("EGM"), one or more devices may be programmed to play various embodiments of the invention. The present invention may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the invention is illustrated in FIG. 2.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 200 of FIG. 2 is an example computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions in accordance with the present invention typically includes a central processor (CPU) 202 coupled to random access memory (RAM) 204 and some variation of read-only memory (ROM) 206. The ROM 206 may also represent other types of storage media to store programs, such as programmable ROM (PROM), erasable PROM (EPROM), etc. The processor 202 may communicate with other internal and external components through input/output (I/O) circuitry 208 and bussing 210, to provide control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to the display 211, which represents a display on which the gaming activities in accordance with the invention are presented. The display 211 represents the "presentation" of the game information in accordance with the invention, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, or inputting data to identify a player for a player loyalty system. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG). The fixed and dynamic symbols generated as part of a gaming activity may be produced using one or more RNGs. RNGs may be implemented using hardware, software operable in connection with the processor 202, or some combination of hardware and software. The present invention is operable using any known RNG, and may be integrally programmed as part of the processor 202 operation, or alternatively may be a separate RNG controller 240. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout device 244 may also be provided in gaming machine embodiments, where the payout device 244 serves as the mechanism providing the payout to the player or participant. In some embodiments, the payout device may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, etc., for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payout device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described hereinabove. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a paytable. The software 232 may include instructions to provide other functionality as known in the art or as described and shown herein.

As discussed above, embodiments of the present concept include providing gaming devices, gaming systems, and methods of operating these devices or systems to provide game play that utilizes operations of providing symbol blocking and respin features on gaming devices. In one embodiment, a method of operating a gaming device includes determining if a jumbo symbol that fills a plurality of reel strips completely, and generating a jumbo reel when the jumbo symbol fills the plurality of reel strips. This jumbo reel may be filled with the symbol that originated the win, where each symbol is associated with a different subsymbol, or may be populated with other high value symbols. The jumbo reel may then be spun and the results of the jumbo reel spin shown on the game display. Here, the subsymbol feature may be applied to the reels, such as a random multiplier, extend left, extend right, extend up, etc., or the high value symbols may be evaluated with the other symbols on the game grid from the first gaming event outcome.

Many possible variations exist, where the subsymbols may be associated with any of the following features or a combination of the features:

Expand Right—The Jumbo window would expand to the right creating greater pays. —This could then trigger the sub symbol feature again—triggering a 4 column wide jumbo reel.

Expand Left—Same as expanding right. This could apply if the jumbo symbol landed after reel 1.

Expand Up/Down—The symbol could extend up or down, creating more pays in a multiway game, or causing new pay lines to form.

In some embodiments, instead of just one subsymbol on the jumbo reel, each row could spin independently for a variation of these combos. In some embodiments, in order to activate the feature, one of the symbols in the block must have a special subsymbol attached. Blocks of symbols entirely without the triggering subsymbol would not be eligible for a respin FIGS. 3A, 3B, 3C, and 3D are diagrams of a game display 300 showing a progression of game play with a multi-reel symbol according to embodiments of the invention. Referring to FIGS. 3A-3D, the game display 300 is shown having a 4×5 gaming grid 310 along with game meters 306, 308 and a player interface button 350. The gaming grid 310 includes five game reels that each have four reel stop positions visible as part of a game outcome. Game symbols 312 populate the reel and form the reel strips associated with each reel in the game device. Although five continuous reels are shown in this embodiment, each reel stop position may have its own independent reel strip associated with it in other embodiments.

Figure 3A:
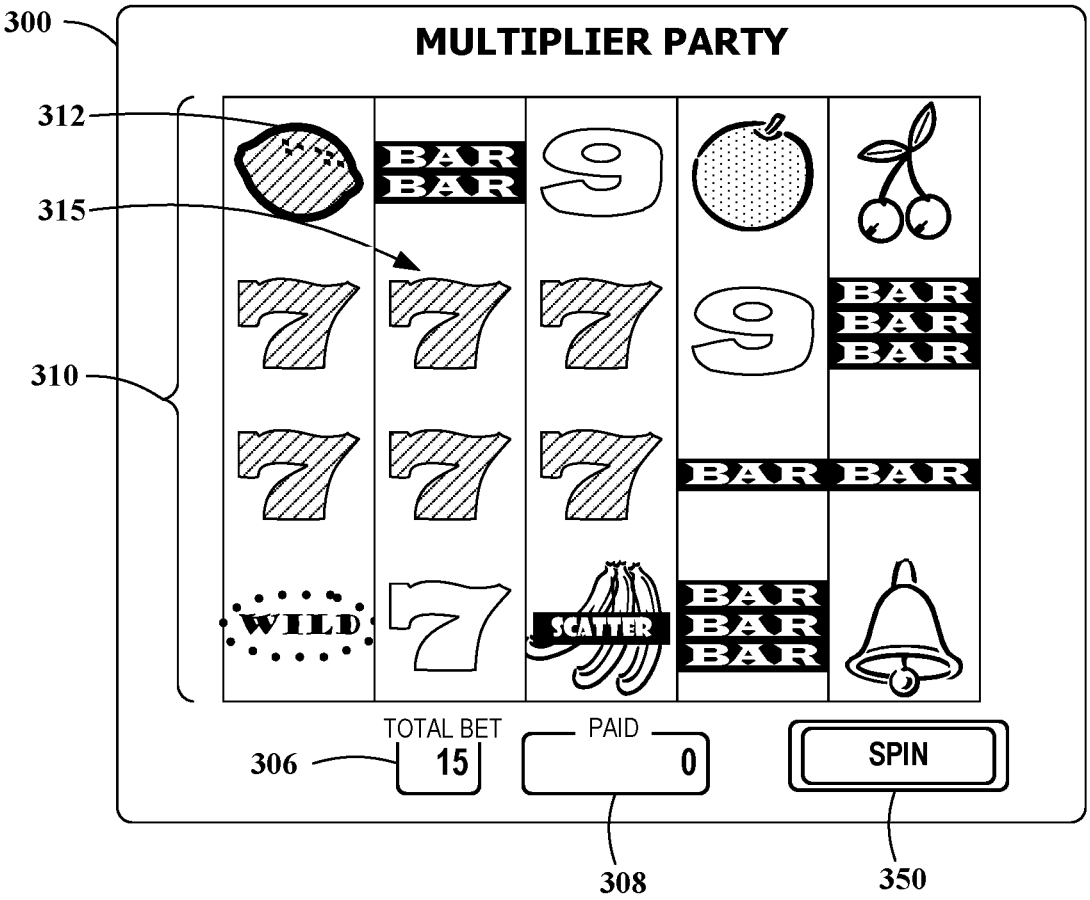
FIGS. 3A, 3B, 3C, and 3D are diagrams of a game display showing a progression of game play with a multi-reel symbol according to embodiments of the invention.

In FIG. 3A, the outcome of a first gaming event is shown on the game grid 310 of the game display 300. This outcome includes a group of shaded-7 symbols 315 positioned adjacent to each other on reels 1, 2, and 3. After this outcome is received, the adjacent, identical symbols are visually locked or fused together to form block symbols, as shown in FIG. 3B.

Figure 3B:
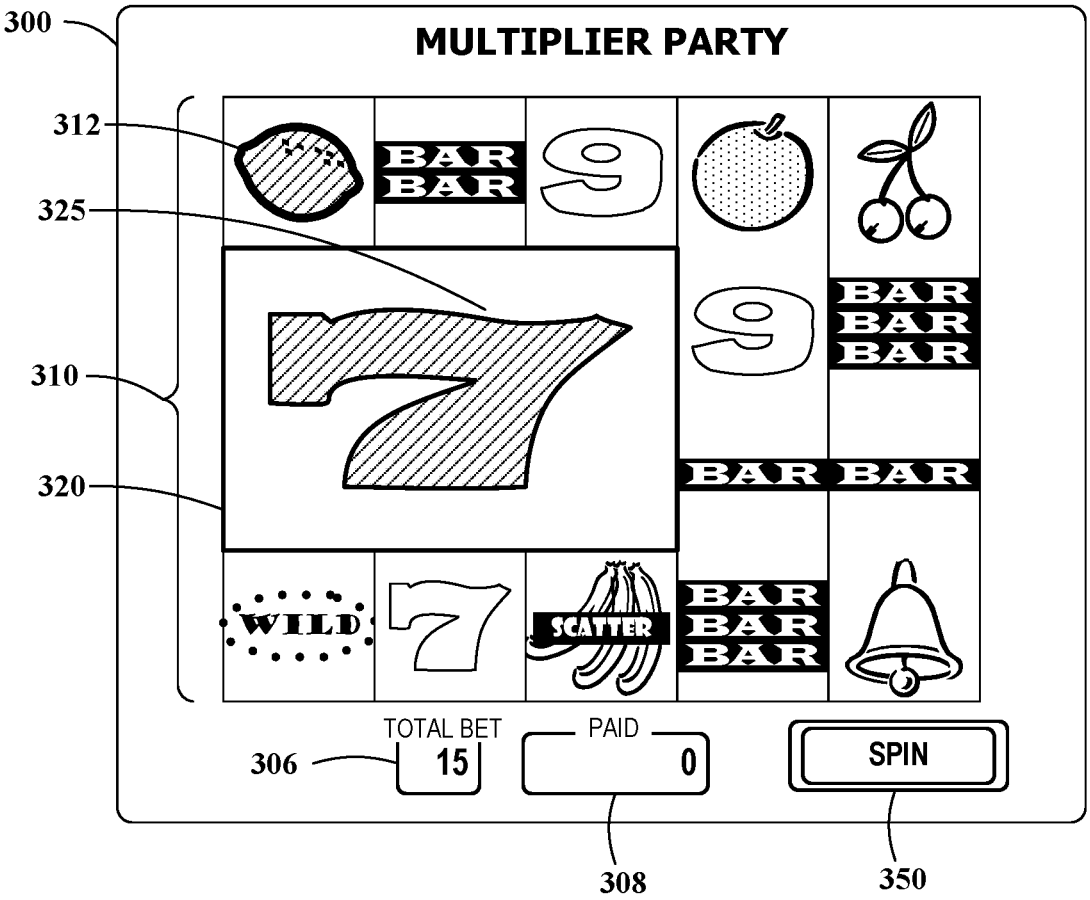

Referring to FIG. 3B, the game grid 310 of the game display 300 now illustrates a multi-reel symbol (or block symbol) 325. As discussed above, block symbols may be of any size that fit within the game reels.

Figure 3C:
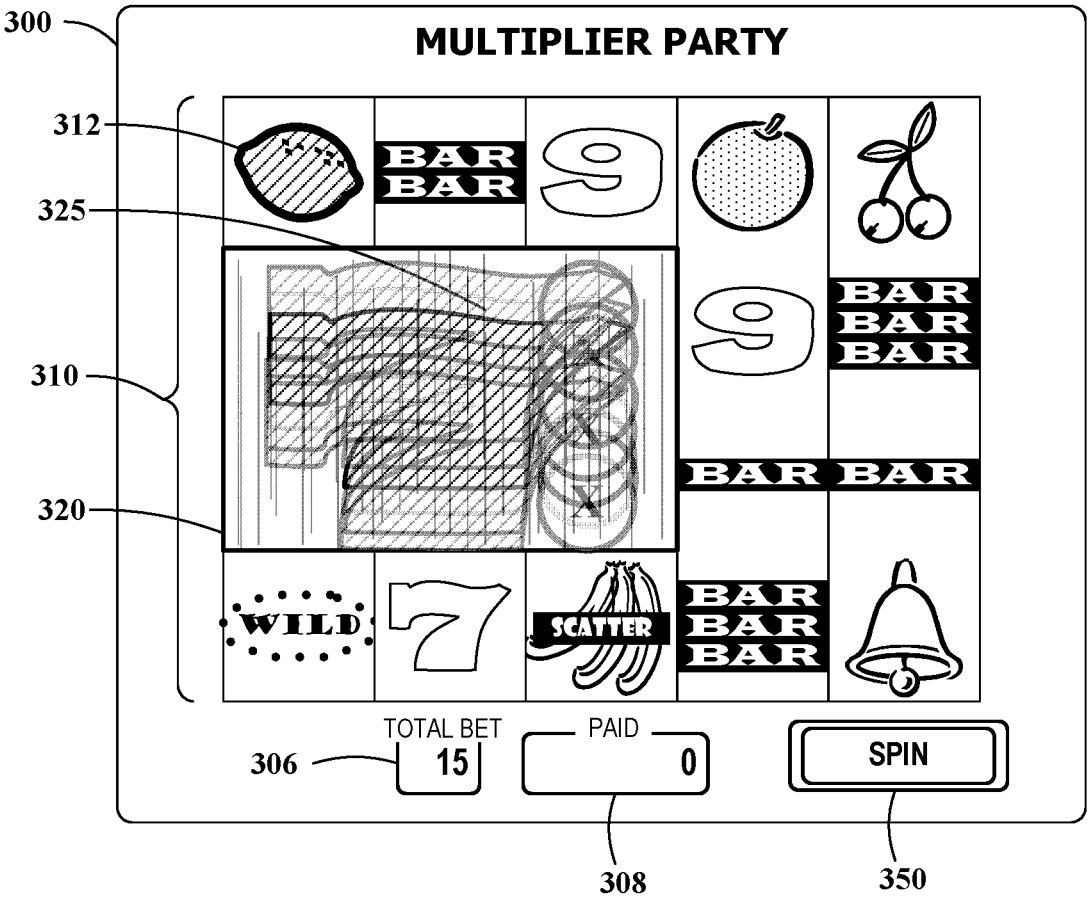

Referring to FIG. 3C, a reel may be formed in the block 320 where multiple versions of the block symbol 325 are spun. Some (or all) of these instances of the block symbol may be associated with a multiplier or other modifier, which may be represented by a sub-symbol, overlay, or other visual indicator associated with each block symbol. In other embodiments, various other symbols, such as high value symbols (wilds, bonus symbols, etc.) may also be part of the reel in the block 320.

Figure 3D:
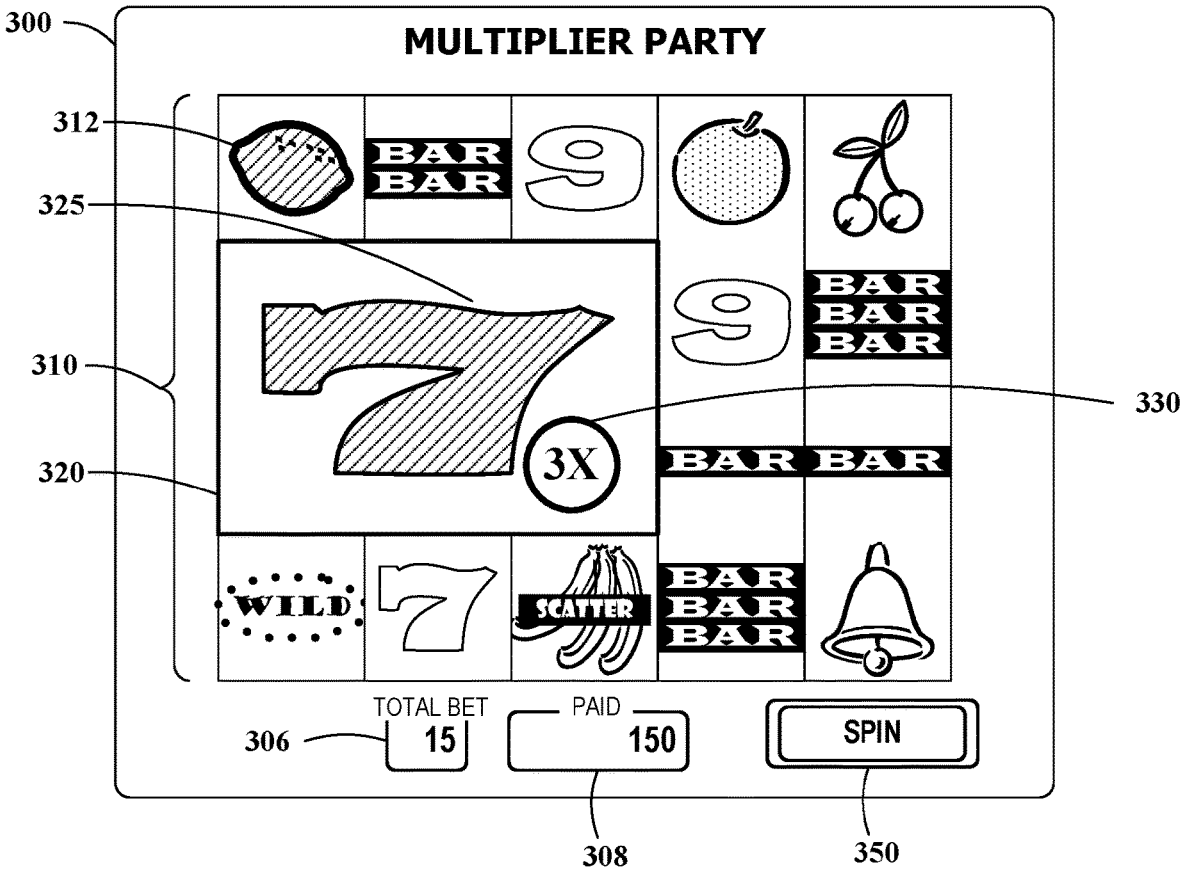

Referring to FIG. 3D, the reel in the block 320 comes to a stop showing the original block symbol 325 that is now associated with a "3×" multiplier 330 that can be used to modify this second game outcome. In particular, the multiplier 330 can be used to multiply any awards from an evaluation of the game grid 310.

Although FIGS. 3A-3D show that only identical symbols are grouped into block or multi-reel symbols, other embodiments may include blocking or grouping other non-identical symbols into block symbols. For example, if one of the shaded-7 symbols 315 in FIG. 3A was another symbol, a rule may indicate that if five out of six symbols in a 2×3 area match, that the entire 2×3 area is converted or transformed into a block symbol. As discussed below, various other rules may be applied to form multi-reel symbols for use in a second game where non-identical symbols are present in a first game outcome.

In some embodiments, a game may require a minimum number of identical symbols (or other triggering symbols) in a particular pattern to form a multi-reel or block symbol. For example, in some embodiments, a rule states that the minimum size for a block symbol is 2×2. Hence, receiving the two single-bar symbols adjacent to each other on reels 4 and 5 in FIG. 3A would not result in the formation of a block symbol across reels 4 and 5.

Figure 4:
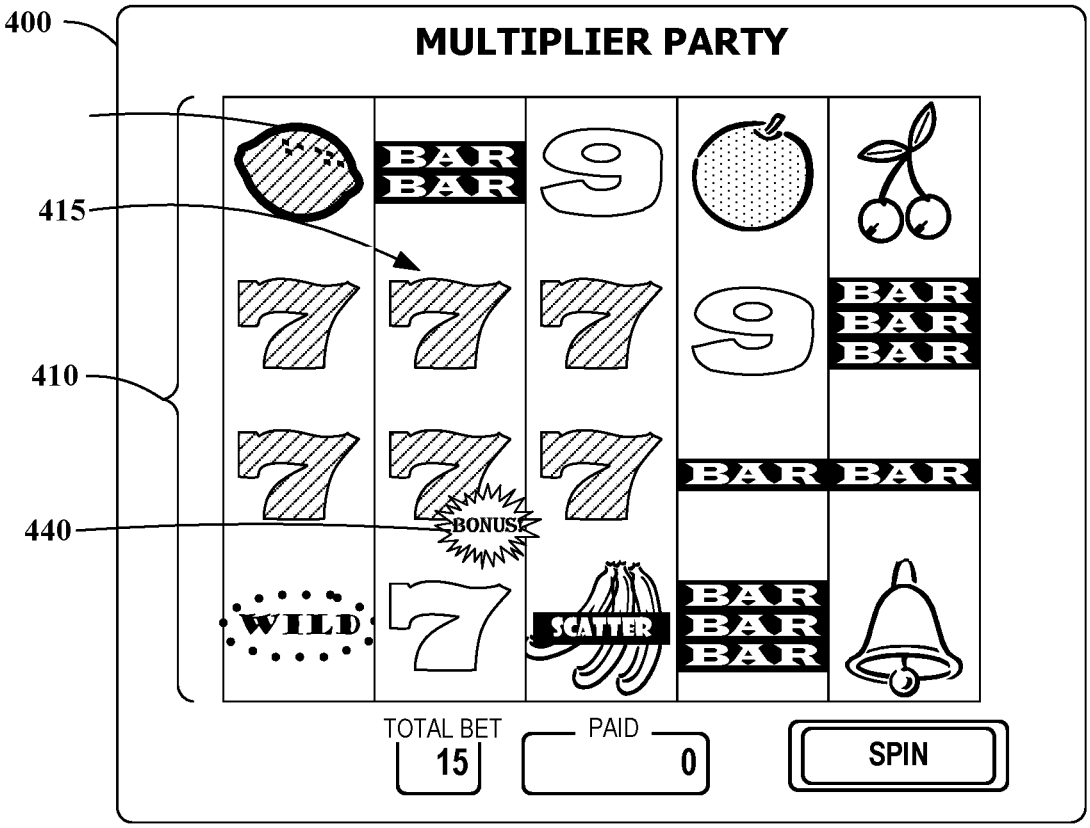
FIG. 4 is a diagram of a game display showing a multi-reel symbol according to embodiments of the invention.

FIG. 4 is a diagram of a game display 400 showing a multi-reel symbol according to embodiments of the invention. Referring to FIG. 4, many of the elements are similar to those in FIGS. 3A-3D. In FIG. 4, however, multiple adjacent symbols 415 on a game grid 410 are not transformed into a block symbol unless a special trigger is present such as a sub-symbol 440, overlay, or other trigger condition.

Figure 5:
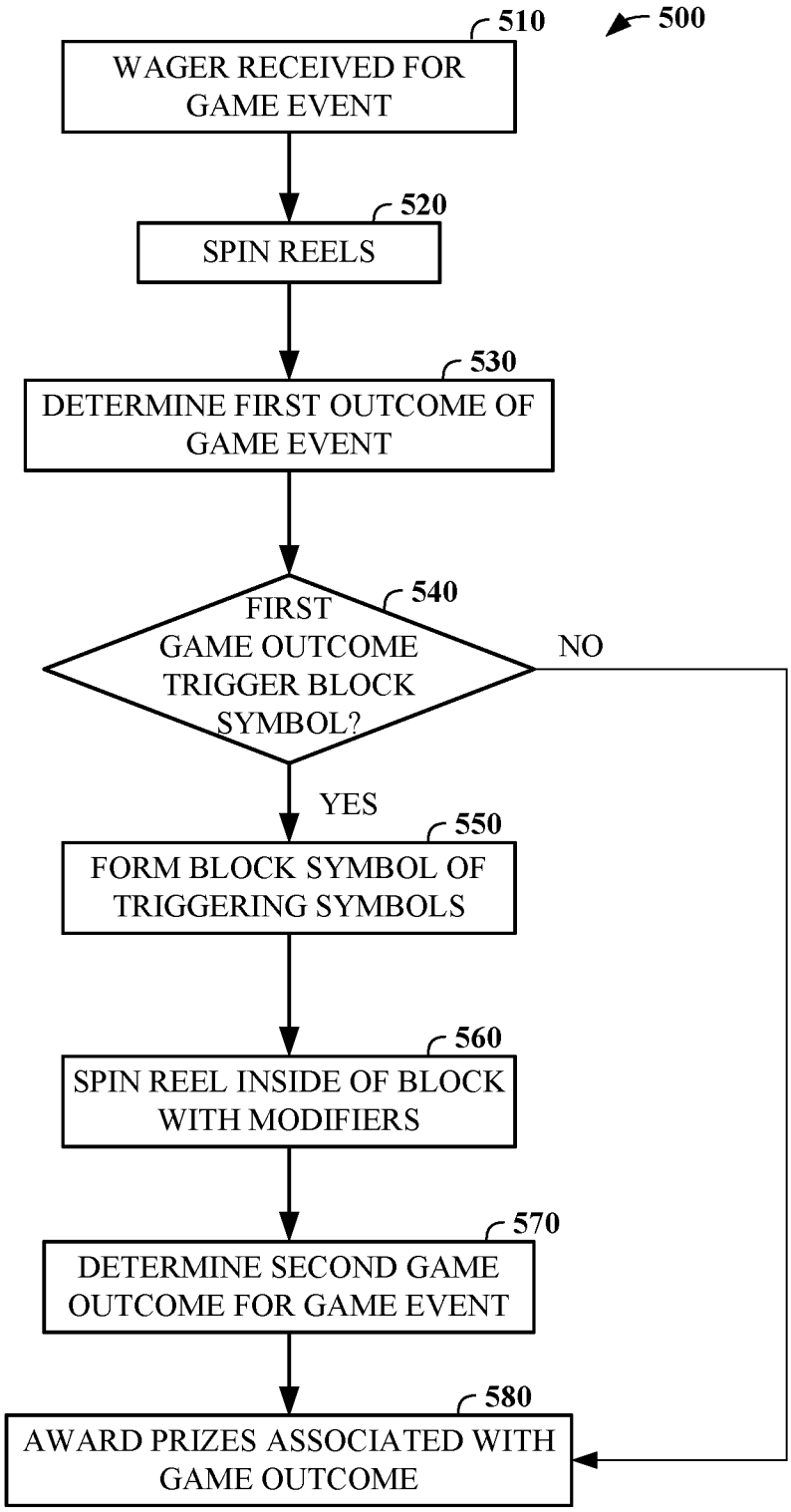
FIG. 5 is a flow diagram of a method of operating a gaming device to implement multi-reel symbols according to embodiments of the invention.

FIG. 5 is a flow diagram of a method of operating a gaming device to implement multi-reel symbols according to embodiments of the invention. Although various processes are shown in a particular order in this flow diagram, the order of these processes can be changed in other embodiments without deviating from the scope or spirit of this concept. Hence, the order of the processes shown is for illustrative purposes only and is not meant to be restrictive. Additional game processes may also be included between various processes even though they are not shown in these flow diagrams for clarity purposes. Further each of the processes may be performed by components in a single game device, such as by a game processor, or may be performed in part or whole by a remote server or processor connected to the gaming device via a network. Each process may be encoded in instructions that are stored in a memory, a computer-readable medium, or another type of storage device.

Note that this example method is just one embodiment of how a game operation can be implemented. As discussed and shown above, many variations exist which may require additional, less, or different processes to complete.

Referring to FIG. 5, flow 500 begins with process 510 where a wager is received in to initiate a first game (although a game could be initiated in other ways, such as an automatic trigger in a free game bonus). The game reels are spun in process 520 to result in a first game outcome, which is determined in process 530. Flow 500 then proceeds to process 540 where a determination is made to form a block symbol based on the presence or lack of trigger conditions associated with the first gaming event. As discussed above, this triggering determination may include determining if identical symbols are adjacent to each other, or whether another triggering condition is present. If a triggering condition is not present as determined in process 540, flow 500 proceeds to process 580 where awards are provided based on the first game outcome.

If a triggering condition is present as determined in process 540, however, flow 500 proceeds to process 550 where a block symbol is formed using the triggering symbols. A reel associated with the block symbol may then be formed and spun in process 560. As discussed, herein, the reel associated with the block symbol may be populated with subsymbols having multipliers or other modifiers, and/or may include other valuable symbols such as wild symbols or bonus symbols. In process 570 a second game outcome is determined using the result of the stopped block reel and any other symbols remaining on the game grid. Flow 500 then proceeds to process 580 where awards associated with the second game outcome are provided.

Figure 6A:
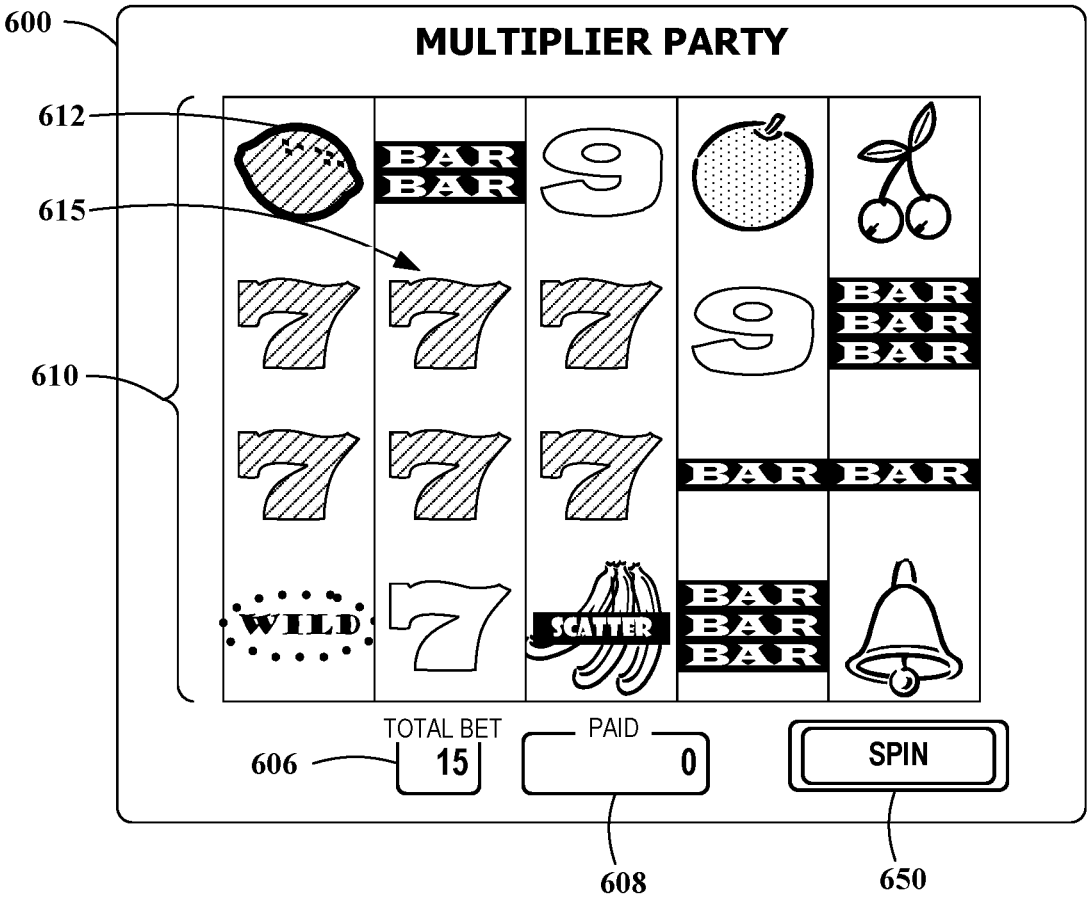
FIGS. 6A, 6B, 6C, 6D, and 6E are diagrams of a game display showing a progression of game play with a multi-reel symbol according to embodiments of the invention.

FIGS. 6A, 6B, 6C, 6D, and 6E are diagrams of a game display 600 showing a progression of game play with a multi-reel symbol according to embodiments of the invention. Referring to FIGS. 6A-3E, the game display 600 is shown having a 4×5 gaming grid 610 along with game meters 606, 608 and a player interface button 650. The gaming grid 610 includes five game reels that each have four reel stop positions visible as part of a game outcome. Game symbols 612 populate the reel and form the reel strips associated with each reel in the game device. Although five continuous reels are shown in this embodiment, each reel stop position may have its own independent reel strip associated with it in other embodiments.

In FIG. 6A, the outcome of a first gaming event is shown on the game grid 610 of the game display 600. This outcome includes a group of shaded-7 symbols 615 positioned adjacent to each other on reels 1, 2, and 3. After this outcome is received, the adjacent, identical symbols 615 are visually locked or fused together to form block symbols, as shown in FIG. 6B.

Figure 6B:
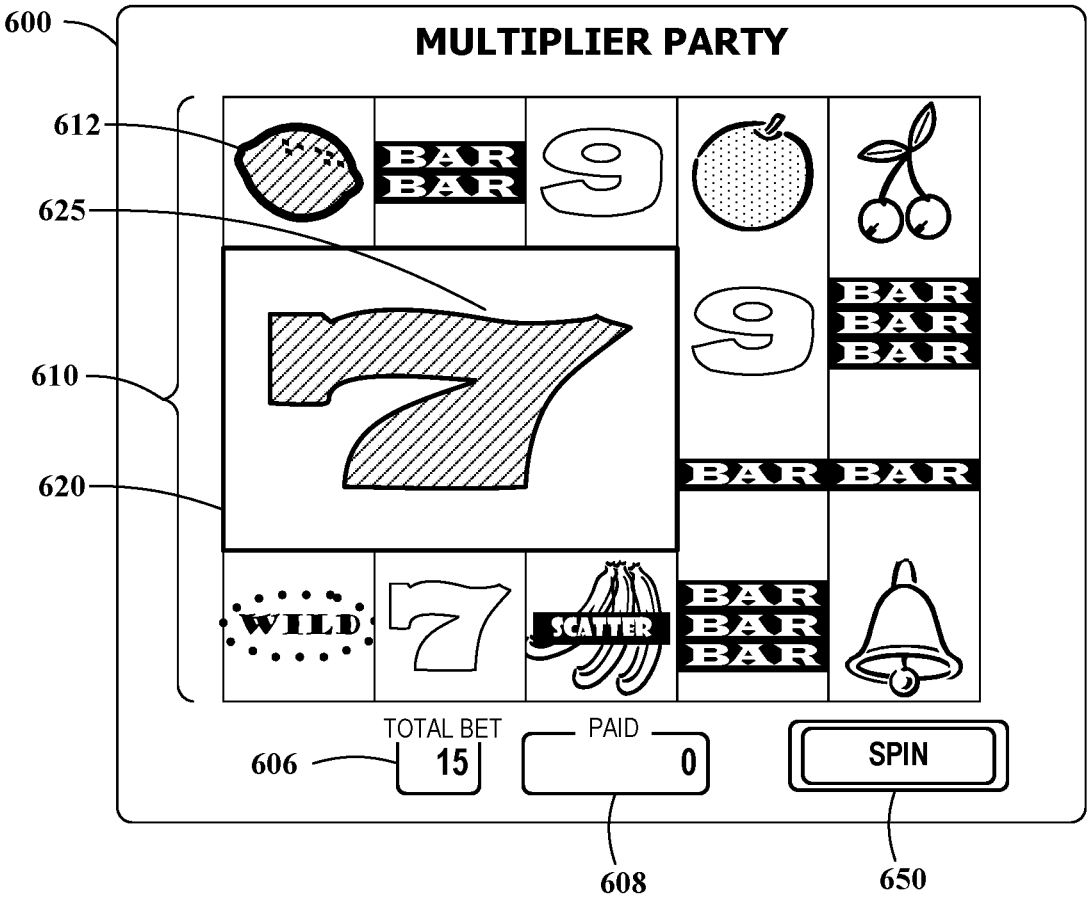

Referring to FIG. 6B, the game grid 610 of the game display 600 now illustrates a multi-reel symbol (or block symbol) 625. As discussed above, block symbols may be of any size that fit within the game reels.

Figure 6C:
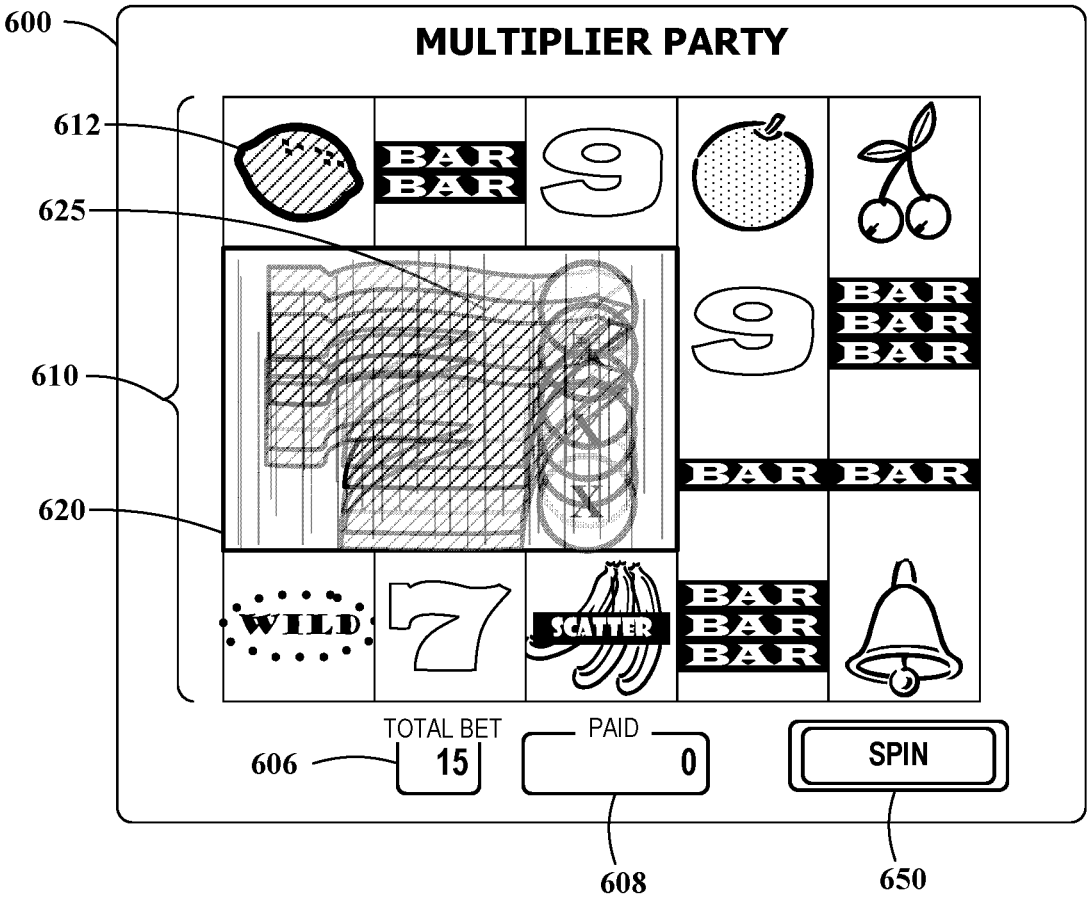

Referring to FIG. 6C, a reel may be formed in the block 620 where multiple versions of the block symbol 625 are spun. Some (or all) of these instances of the block symbol may be associated with a multiplier or other modifier, which may be represented by a sub-symbol, overlay, or other visual indicator associated with each block symbol. In other embodiments, various other symbols, such as high value symbols (wilds, bonus symbols, etc.) may also be part of the reel in the block 620.

Figure 6D:
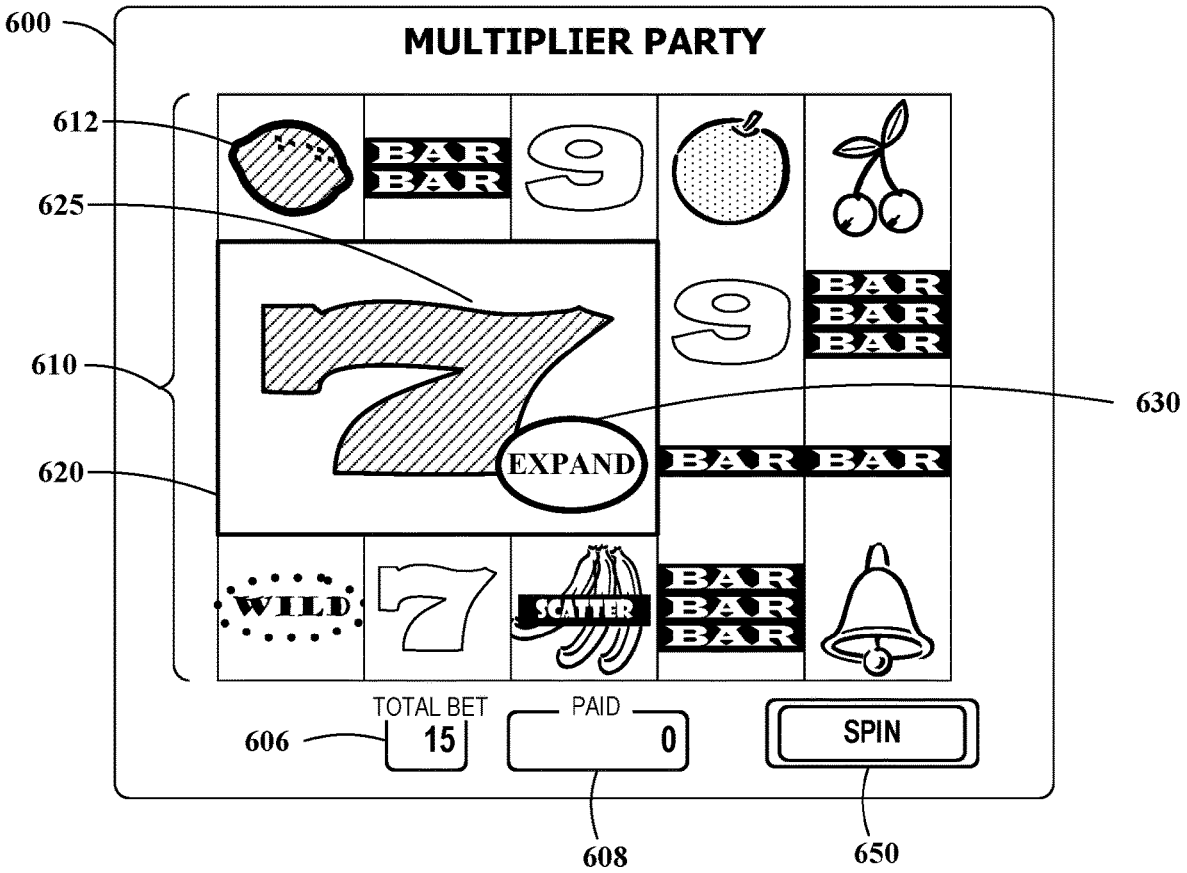

Referring to FIG. 6D, the reel in the block 620 comes to a stop showing the original block symbol 625 that is now associated with a "Expand" modifier 630 that can be used to modify this second game outcome. In particular, the Expand modifier 630 can be used to expand the block 320 and the block symbol 625 to fill the first three reels.

Figure 6E:
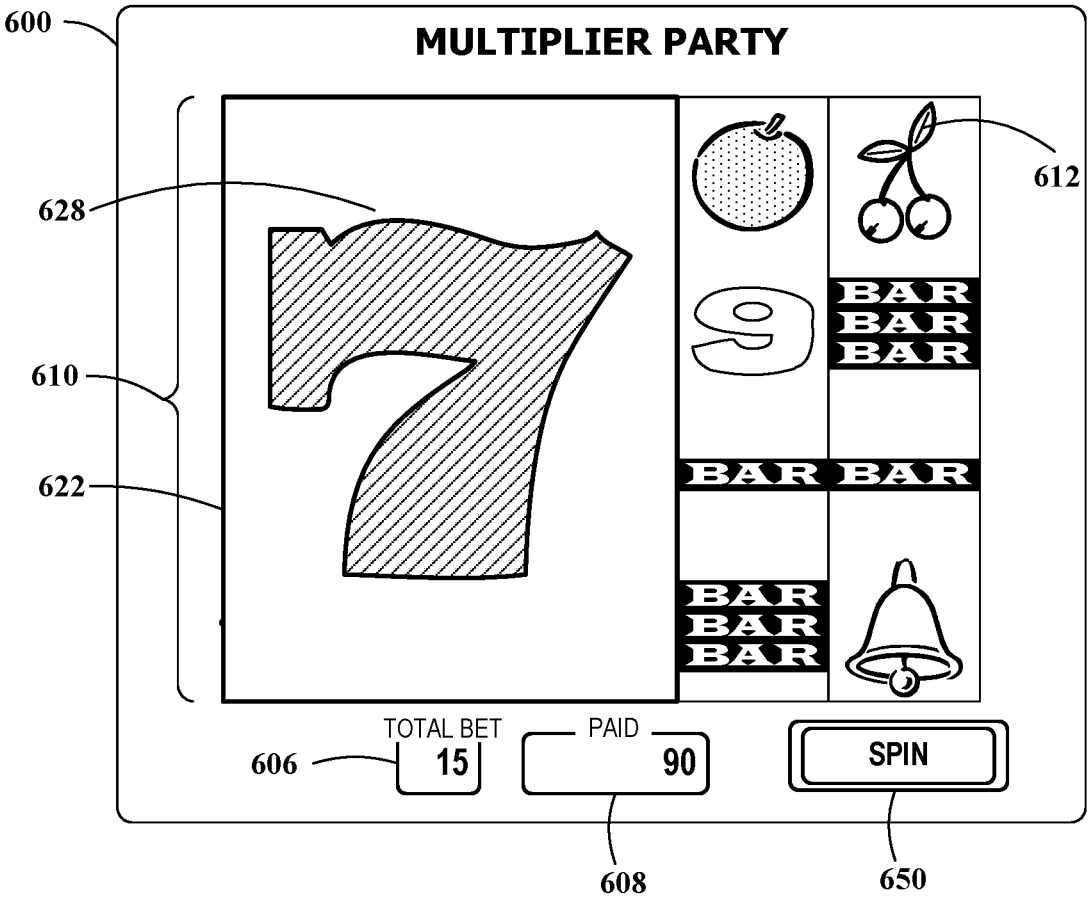

Referring to FIG. 6E, the expanded block 622 and expanded block symbol 628 are shown. Although "expand" in this embodiment referred to filling the associated reels with the block and block symbol, in other embodiments, the "expand" modifier may specify a direction or extent to the expansion.

FIGS. 7A, 7B, 7C, 7D, 7E, 7F, 7G, and 7H are diagrams of a game display showing a progression of game play with a multi-reel symbol according to embodiments of the invention.

Referring to FIGS. 7A-7H, the game display 700 is shown having a 4×5 gaming grid 710 along with game meters 706, 708 and a player interface button 750. The gaming grid 710 includes five game reels that each have four reel stop positions visible as part of a game outcome. Game symbols 712 populate the reel and form the reel strips associated with each reel in the game device. Although five continuous reels are shown in this embodiment, each reel stop position may have its own independent reel strip associated with it in other embodiments.

Figure 7A:
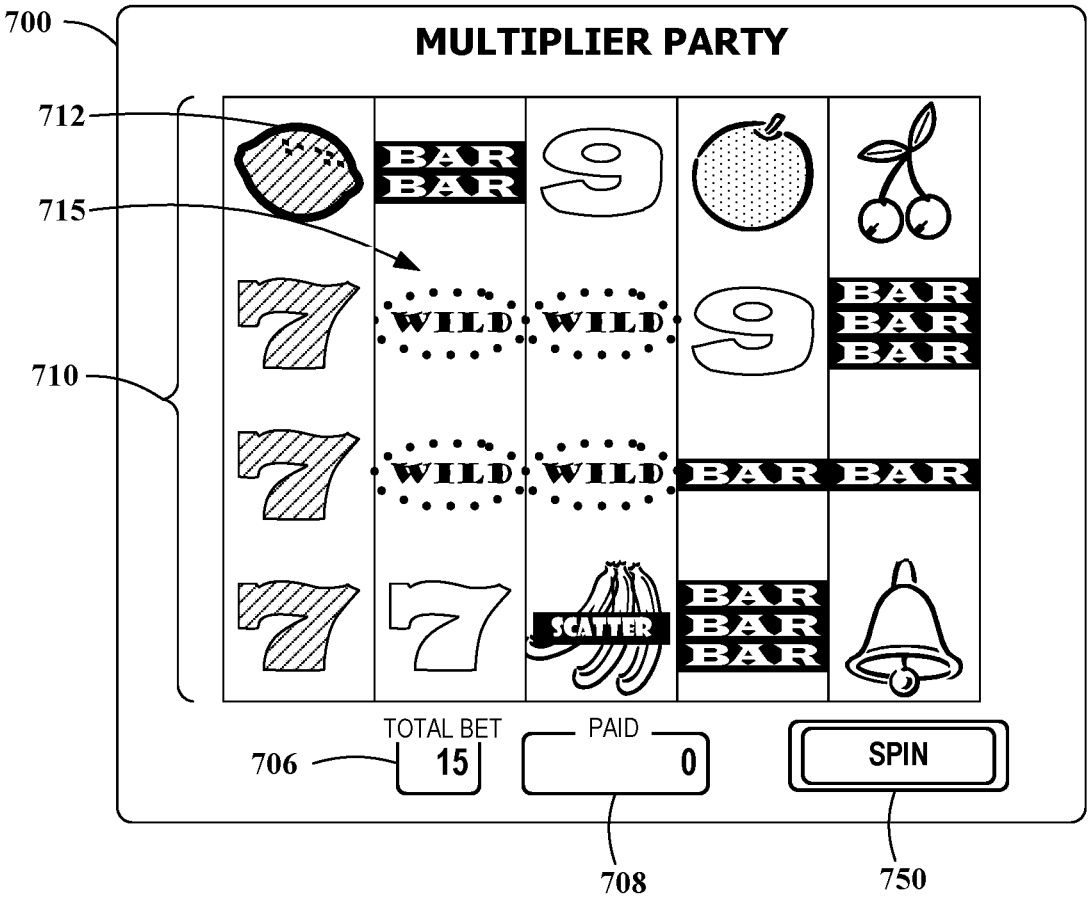
FIGS. 7A, 7B, 7C, 7D, 7E, 7F, 7G, and 7H are diagrams of a game display showing a progression of game play with a multi-reel symbol according to embodiments of the invention.

In FIG. 7A, the outcome of a first gaming event is shown on the game grid 710 of the game display 700. This outcome includes a group of wild symbols 715 positioned adjacent to each other on reels 2 and 3. After this outcome is received, the adjacent, identical symbols 715 are visually locked or fused together to form block symbols, as shown in FIG. 7B.

Figure 7B:
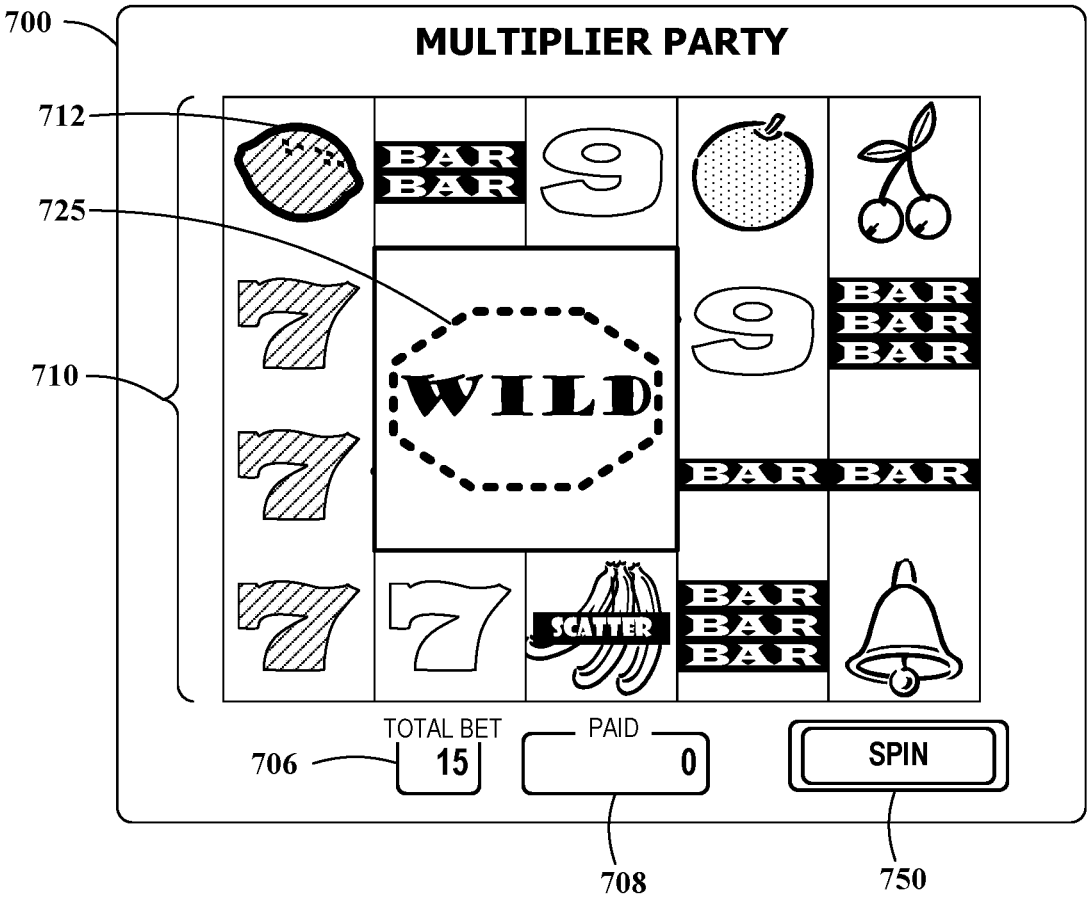

Referring to FIG. 7B, the game grid 710 of the game display 700 now illustrates a multi-reel symbol (or block symbol) 725. As discussed above, block symbols may be of any size that fit within the game reels.

Figure 7C:
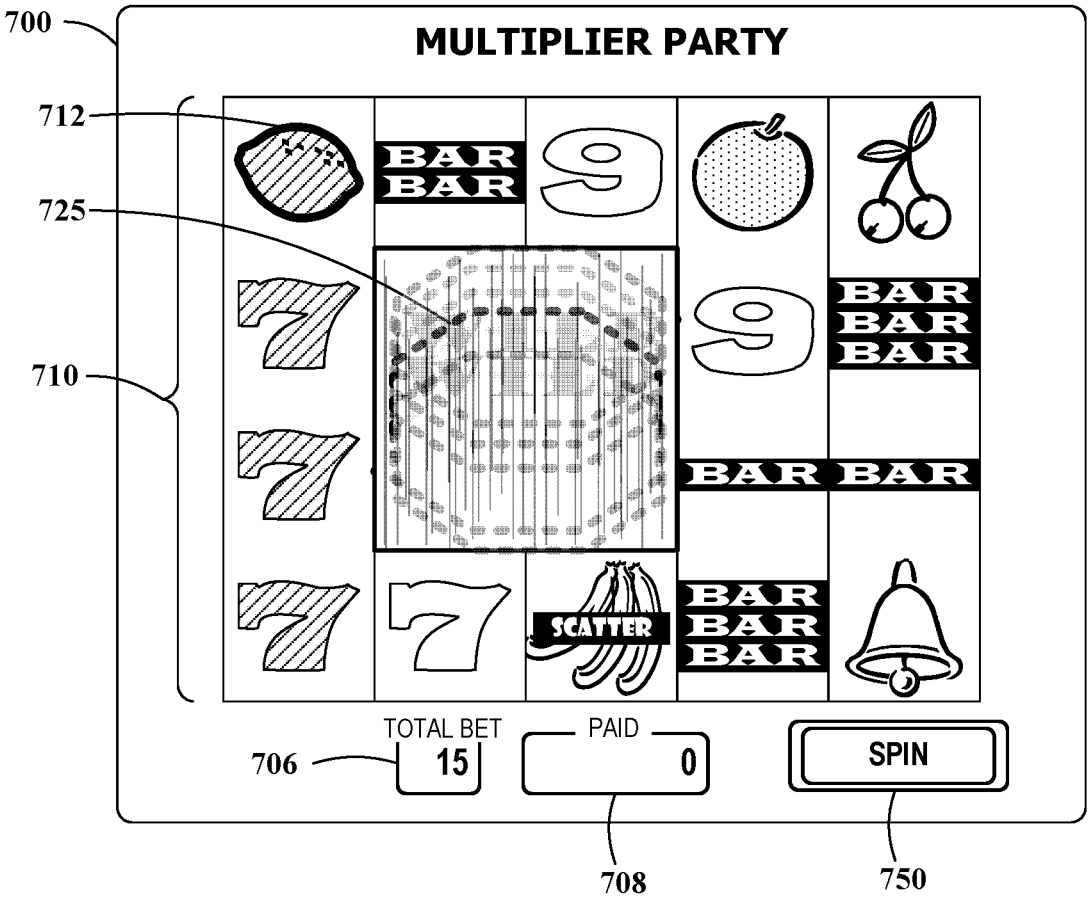

Referring to FIG. 7C, a reel may be formed in the block 720 where multiple versions of the block symbol 725 are spun. Some (or all) of these instances of the block symbol may be associated with a multiplier or other modifier, which may be represented by a sub-symbol, overlay, or other visual indicator associated with each block symbol. In other embodiments, various other symbols, such as high value symbols (wilds, bonus symbols, etc.) may also be part of the reel in the block 720.

Figure 7D:
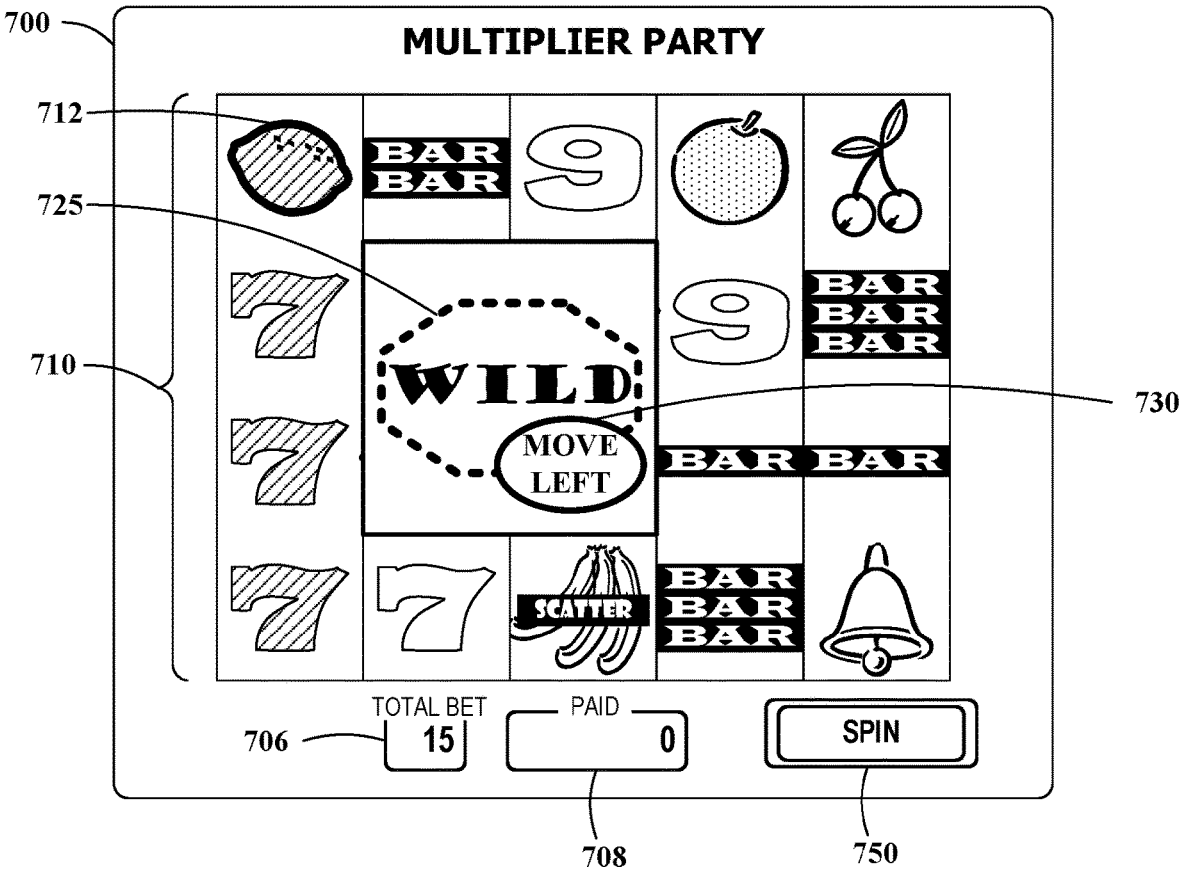

Referring to FIG. 7D, the reel in the block 720 comes to a stop showing the original block symbol 725 that is now associated with a "Move Left" modifier 730 that can be used to modify this second game outcome. In particular, the Move Left modifier 730 can be used to move the block 720 to the left on reels 1 and 2.

Figure 7E:
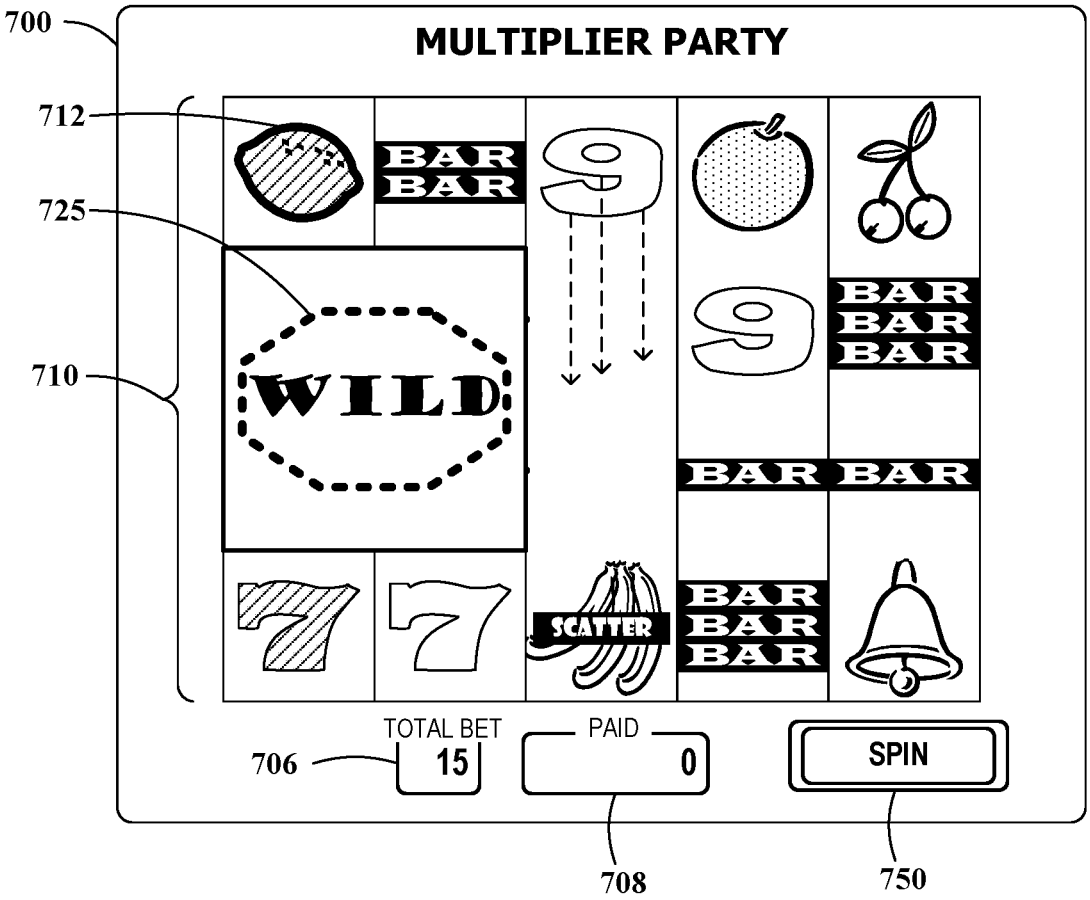

Referring to FIG. 7E, the moved block symbol 725 is shown. Here, the third reel may be respun to fill the missing spaces, copies of the previous wild symbols may remain in the spaces, or (as shown in FIGS. 7E and 7F), symbols positioned above the missing spaces may cascade into the missing spaces.

Figure 7F:
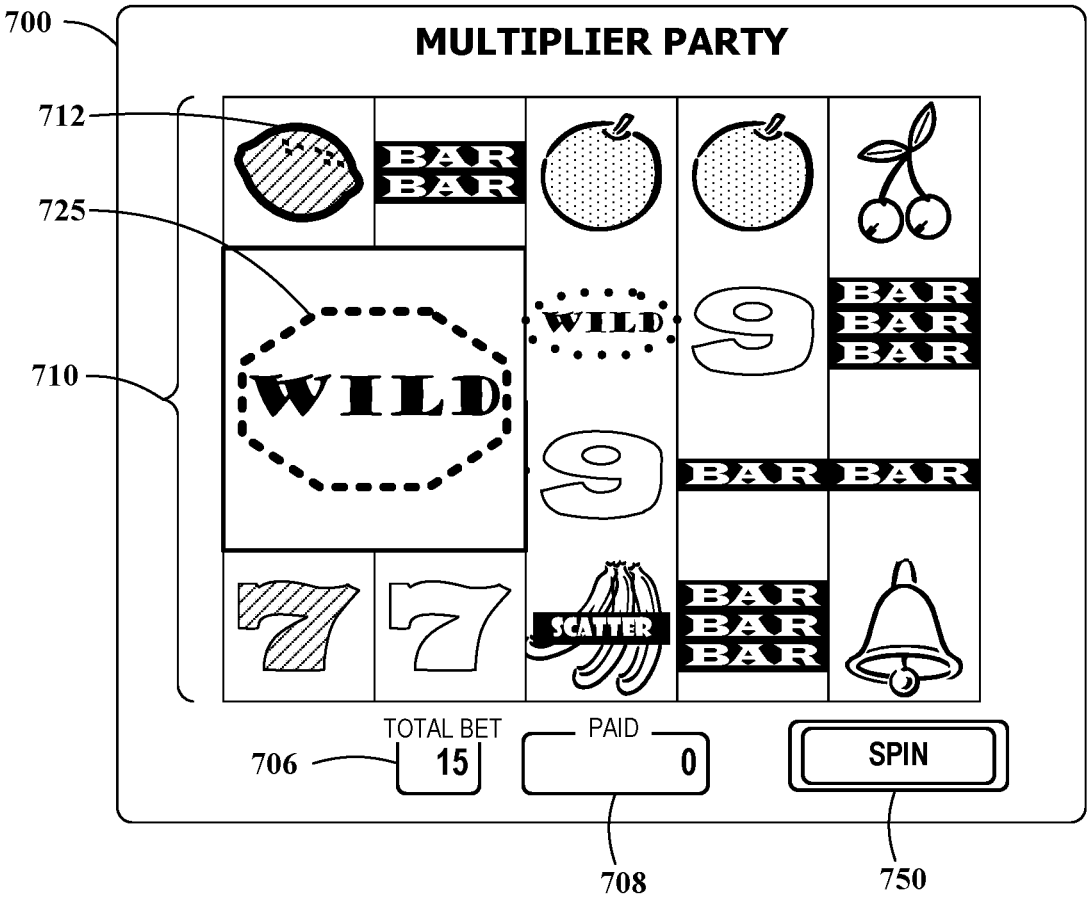

Referring to FIG. 7F, a second game outcome is shown with the missing symbol spaces filled in reel 3. The game grid 710 may be evaluated for wins in this second game outcome. However, in this embodiment, the block symbol can spin multiple times, such as until a terminator subsymbol is received in the block 720.

Figure 7G:
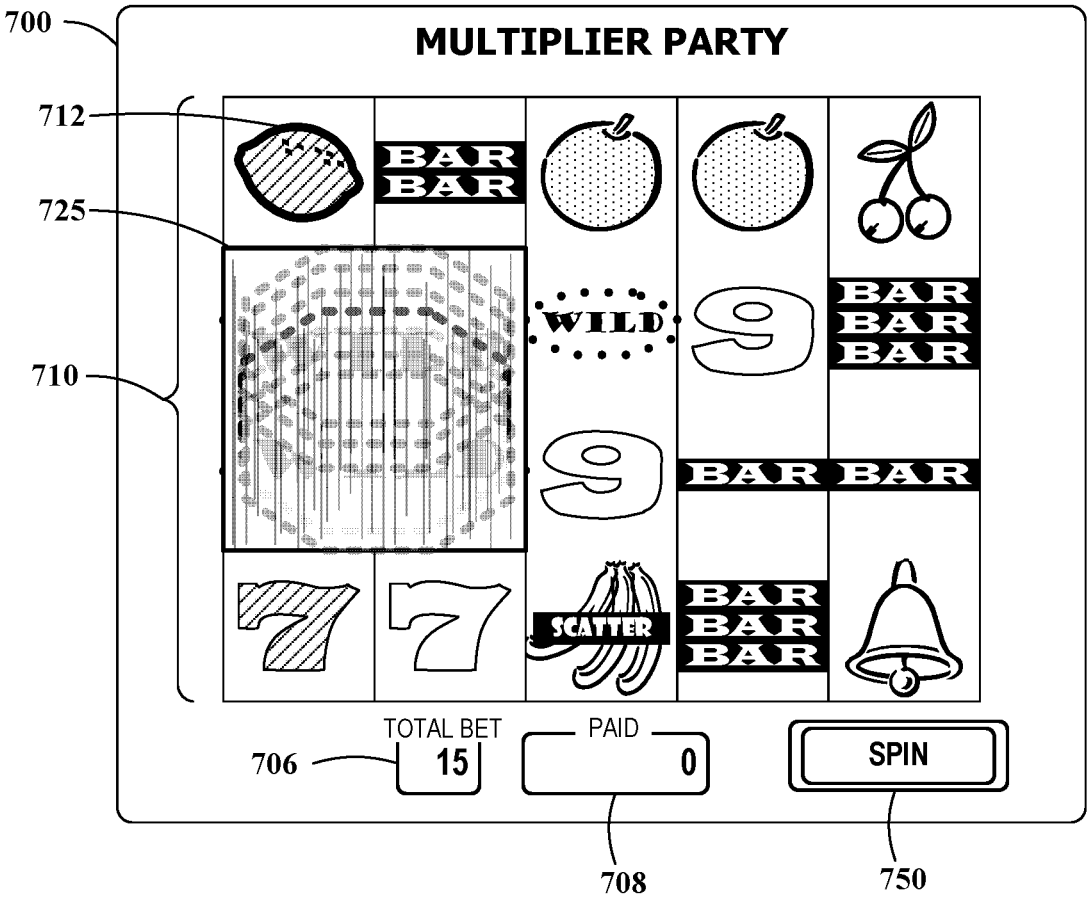

Referring to FIG. 7G, the reel in the block is spun again.

Figure 7H:
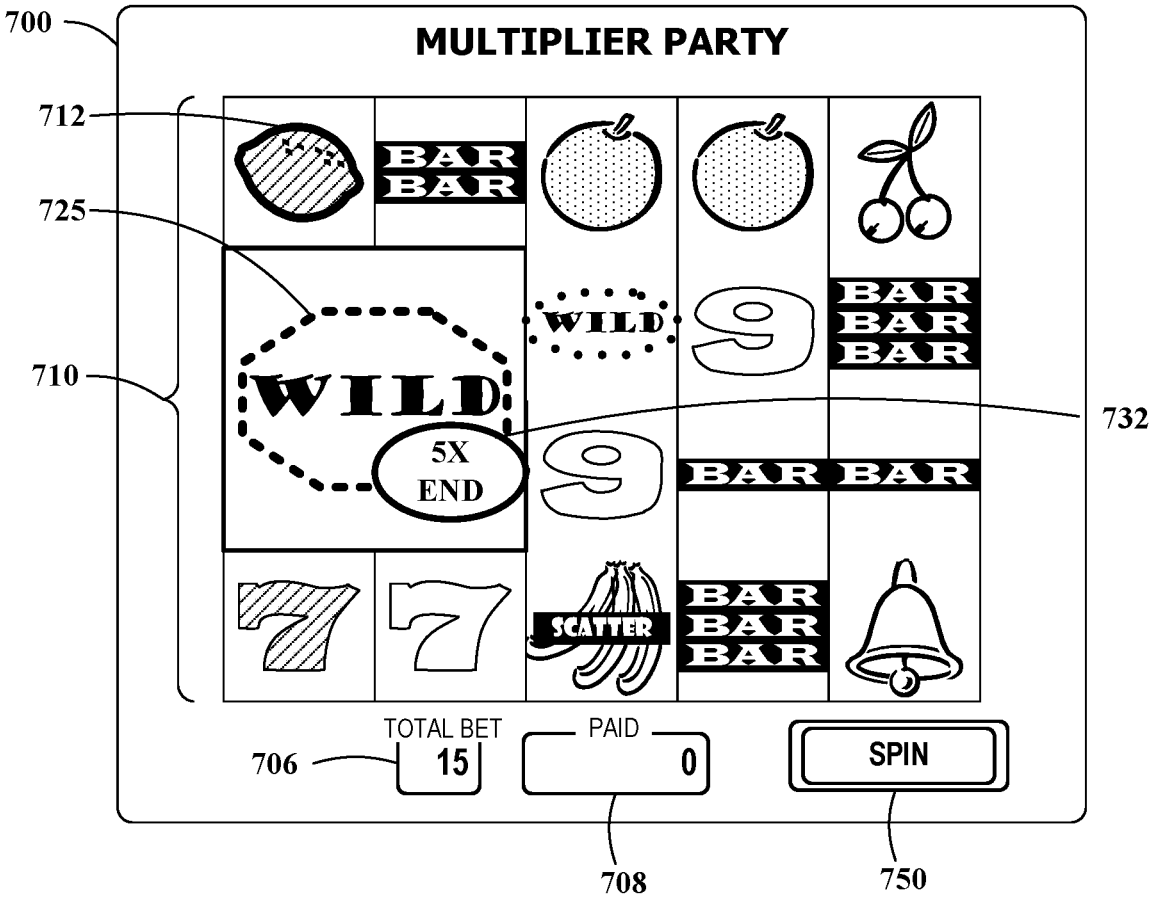

Referring to FIG. 7H, the reel in the block stops to show a "5×" multiplier modifier 732 that is associated with a terminator or end condition. Hence, this third game outcome may be the final one evaluated for awards as part of this gaming event.

FIGS. 8A, 8B, 8C, and 8D are diagrams of a game display showing a progression of game play with a multi-reel symbol according to embodiments of the invention. Referring to FIGS. 8A-8D, the game display 800 is shown having a 3×5 gaming grid 810 along with game meters 806, 808 and a player interface button 850. The gaming grid 810 includes five game reels that each have three reel stop positions visible as part of a game outcome. Game symbols 812 populate the reel and form the reel strips associated with each reel in the game device. Although five continuous reels are shown in this embodiment, each reel stop position may have its own independent reel strip associated with it in other embodiments. Here, the first three reels may have to be filled with a symbol in order for a block to form and a block feature to activate.

Figure 8A:
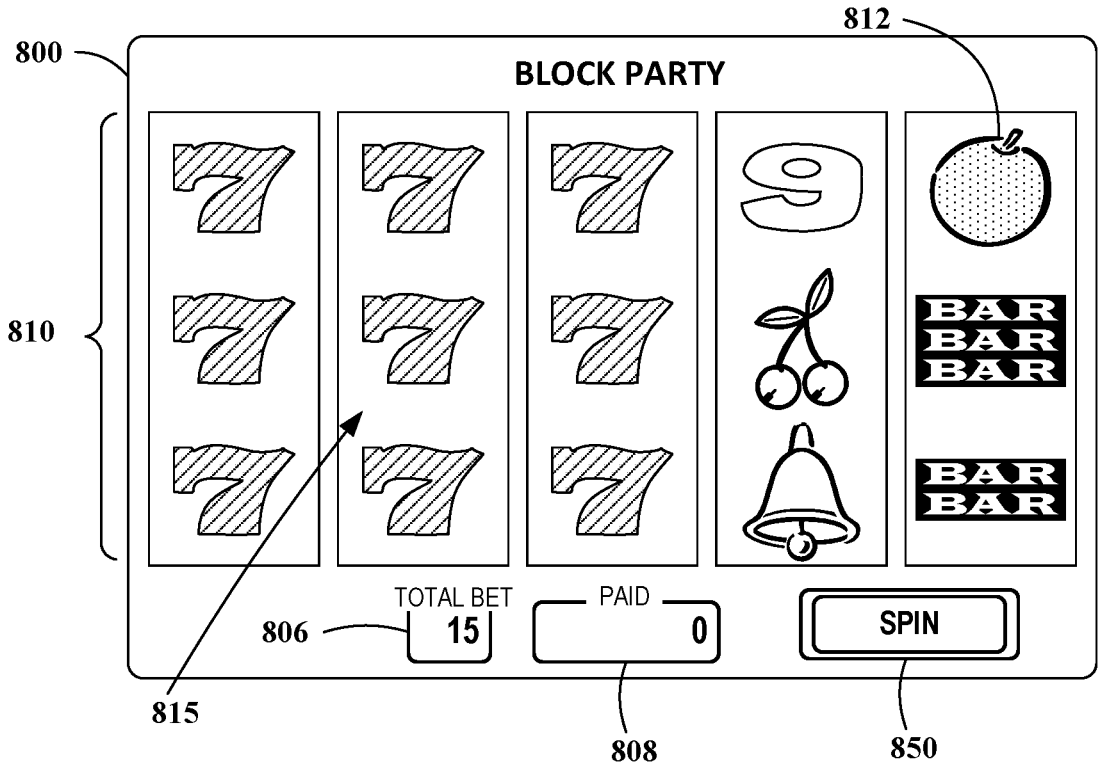
FIGS. 8A, 8B, 8C, and 8D are diagrams of a game display showing a progression of game play with a multi-reel symbol according to embodiments of the invention.

In FIG. 8A, the outcome of a first gaming event is shown on the game grid 810 of the game display 800. This outcome includes a group of shaded-7 symbols 815 positioned adjacent to each other on reels 1, 2, and 3. After this outcome is received, the adjacent, identical symbols are visually locked or fused together to form block symbols, as shown in FIG. 8B.

Figure 8B:
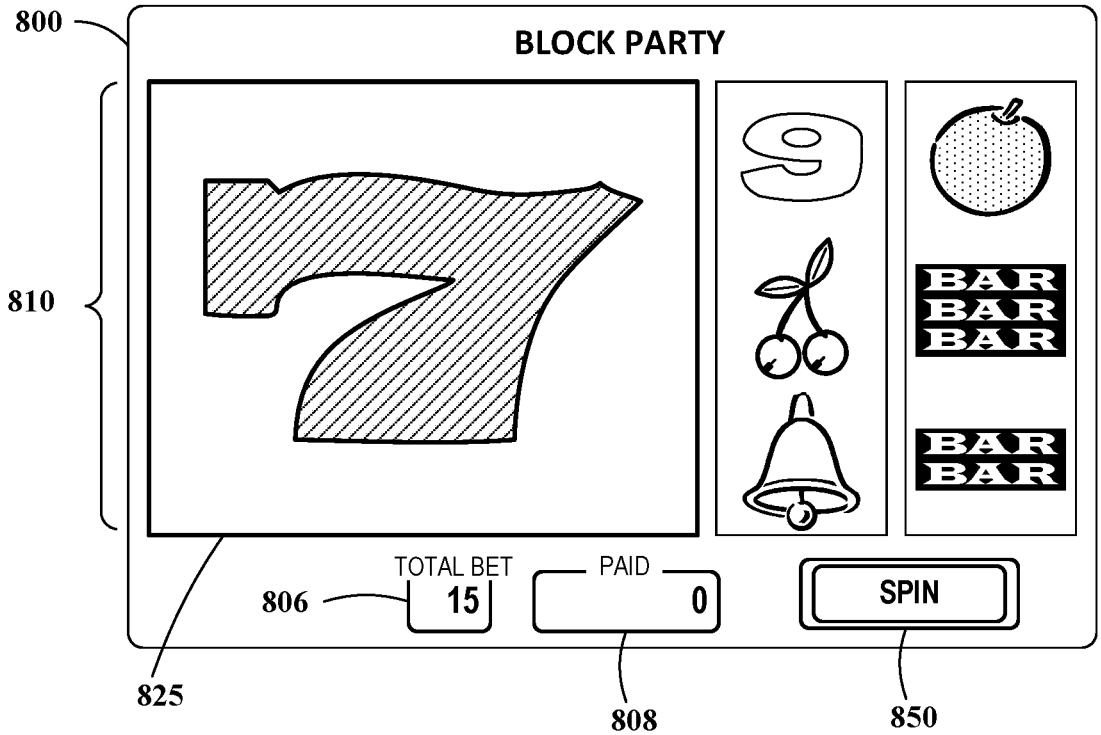

Referring to FIG. 8B, the game grid 810 of the game display 800 now illustrates a multi-reel symbol (or block symbol) 825. As discussed above, block symbols may be of any size that fit within the game reels.

Figure 8C:
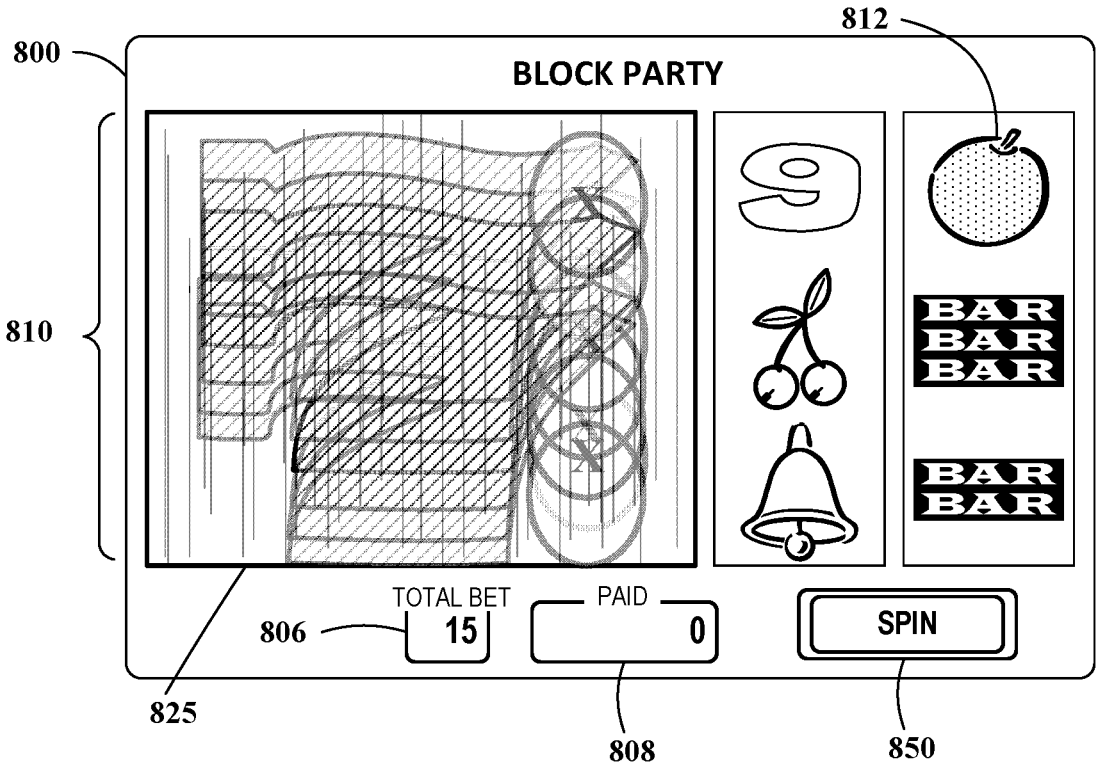

Referring to FIG. 8C, a reel may be formed in the block 820 where multiple versions of the block symbol 825 are spun along with other valuable symbols.

Figure 8D:
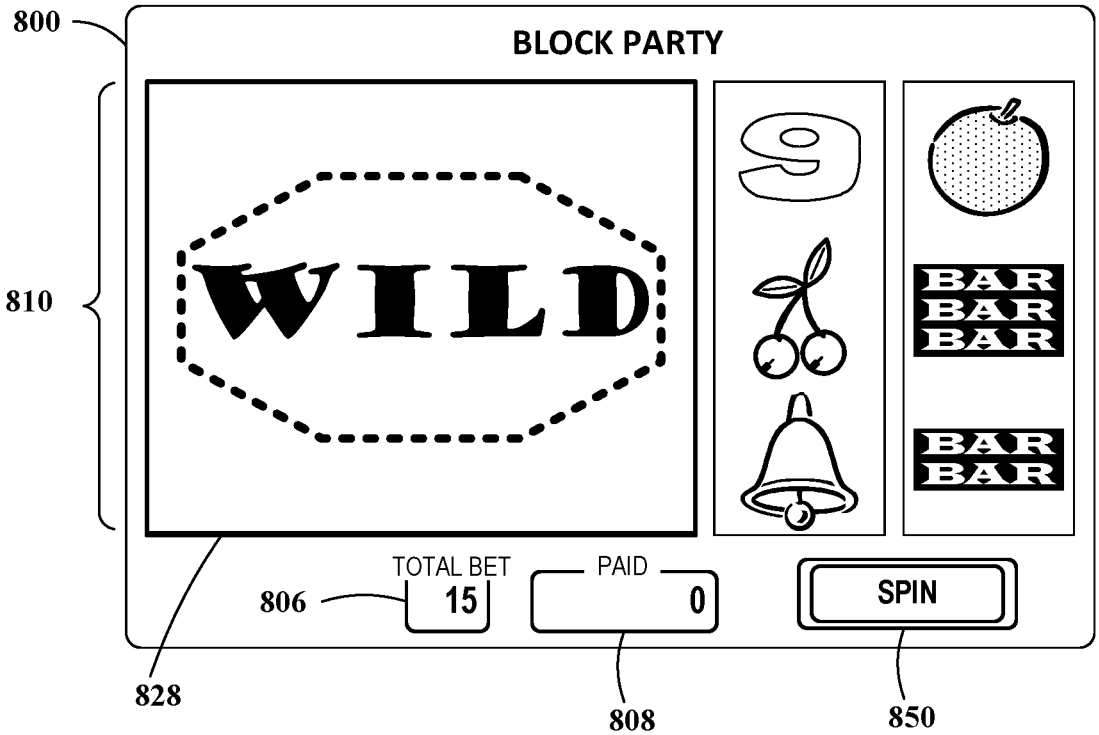

Referring to FIG. 8D, the reel in the block 820 comes to a stop showing a new wild block symbol 828. This second game outcome may then be evaluated for awards.

The foregoing description of the exemplary embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments of the invention have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above and in the appended claims.

The invention claimed is:

1. A gaming device comprising:

a display including a video screen having a game play grid showing portions of a plurality of game reels;

a player interface including at least one button, the button configured to generate a signal in response to being activated;

a wager input device structured to receive physical items associated with currency values;

a memory configured to store a credit amount; and a processor operable to:

receive a signal from the wager input device indicating receipt of a physical item associated with a currency value, increase the credit amount stored in the memory based on the currency value of the received physical item, receive a first game initiation signal indicating a wager amount, the wager amount deducted from the credit amount stored in the memory, determine an outcome for a first gaming event, display the determined first game outcome in the game play grid of the display, form a multi-reel symbol that covers symbol positions on both a first game reel and a second game reel when a block trigger condition is satisfied during the first gaming event, provide an independent secondary reel in the symbol positions covered by the multi-reel symbol, the secondary reel including instances of the multi-reel symbol with various modifiers associated with at least some instances of the multi-reel symbol on the secondary reel, spin the secondary reel where the multi-reel symbol is located, determine a second game outcome, where the outcome determination for the second game outcome includes using the result of the secondary reel spin, display the determined second game outcome in the game play grid of the display, evaluate the determined second game outcome to identify winning symbol combinations, and provide awards associated with any identified winning symbol combinations for the second game outcome, where the credit amount stored in the memory is increased based on the provided awards associated with the second game outcome.

2. The gaming device of claim 1, wherein at least one of the modifiers associated with an instance of the multi-reel symbol is a multiplier value.

3. The gaming device of claim 1, wherein at least one of the modifiers associated with an instance of the multi-reel symbol is an expansion modifier that expands the multi-reel symbol to fill any game reels associated with the multi-reel symbol.

4. The gaming device of claim 1, wherein the secondary reel includes a wild block symbol.

5. The gaming device of claim 1, wherein the operation of the processor to evaluate the determined second game outcome to identify winning symbol combinations includes evaluating the multi-reel symbol as a plurality of independent symbols.

6. The gaming device of claim 1, wherein the operation of the processor to evaluate the determined second game outcome to identify winning symbol combinations includes evaluating the multi-reel symbol as a single symbol.

7. The gaming device of claim 1, wherein the operation of the processor to evaluate the determined second game outcome to identify winning symbol combinations includes associating an outcome modifier with the multi-reel symbol.

8. The gaming device of claim 7, wherein the operation of the processor to associated an outcome modifier with the multi-reel symbol includes associating a movement modifier that specifies a movement direction for the multi-reel symbol.

9. The gaming device of claim 1, where the block trigger condition is satisfied when a first symbol on the first game reel is substantially similar to an adjacent second symbol on the second game reel.

10. The gaming device of claim 1, where the block trigger condition is satisfied when a first symbol on the first game reel includes a bonus subsymbol.

11. A method of operating a gaming device including a display having a game play grid showing portions of a plurality of game reels, a wager input device structured to receive physical items associated with currency values, a memory configured to store a credit amount, and a processor, the method comprising:

receiving a signal from the wager input device indicating receipt of a physical item associated with a currency value;

increasing the credit amount stored in the memory based on the currency value of the received physical item;

receiving a first game initiation signal indicating a wager amount, the wager amount deducted from the credit amount stored in the memory;

determining an outcome for a first gaming event;

displaying the determined first game outcome in the game play grid of the display, determining if a block-creating criterion is satisfied based on the determined first game outcome;

forming a first block symbol on a first game reel and a second game reel when the block-creating criterion is satisfied, the first block symbol occupying symbol positions on both the first game reel and the second game reel;

spinning a secondary reel in the symbol positions occupied by the first block symbol, the secondary reel including at least the first block symbol and a second block symbol different from the first block symbol;

determining a second game outcome, where the outcome determination for the second game outcome includes using the result of the secondary reel spin;

displaying the determined second game outcome in the game play grid of the display, evaluating the determined second game outcome to identify winning symbol combinations; and providing awards associated with any identified winning symbol combinations for the second game outcome, where the credit amount stored in the memory is increased based on the provided awards associated with the second game outcome.

12. The method of claim 11, further comprising replacing the secondary reel with the original symbols from the outcome of the first gaming event that were used to form the first block symbol after displaying the second game outcome.

13. The method of claim 11, further comprising re-spinning the secondary reel to provide a third game outcome.

14. The method of claim 13, wherein the secondary reel is re-spun until a terminator symbol is received on the secondary reel.

15. The method of claim 13, wherein the secondary reel is re-spun until no winning symbol combinations are identified for a resulting game outcome.

16. The method of claim 13, wherein the secondary reel is re-spun until at least one winning symbol combination is identified for a resulting game outcome.

17. A gaming device comprising:

a display including a video screen having a game play grid showing portions of a plurality of game reels;

a wager input device structured to receive physical items associated with currency values;

a memory configured to store a credit amount; and a processor operable to:

receive a signal from the wager input device indicating receipt of a physical item associated with a currency value, increase the credit amount stored in the memory based on the currency value of the received physical item, receive a first game initiation signal indicating a wager amount, the wager amount deducted from the credit amount stored in the memory, determine an outcome for a first gaming event, display the determined first game outcome in the game play grid of the display, form a multi-reel symbol that covers symbol positions on both a first game reel and a second game reel when a block trigger condition is satisfied during the first gaming event, provide an independent secondary reel in the symbol positions covered by the multi-reel symbol, the secondary reel including at least the multi-reel symbol, a modified version of the multi-reel symbol, and a multi-reel wild symbol, spin the independent secondary reel, determine a second game outcome, where the outcome determination for the second game outcome includes using the result of the secondary reel spin, display the determined second game outcome in the game play grid of the display, evaluate the determined second game outcome to identify winning symbol combinations, and provide awards associated with any identified winning symbol combinations for the second game outcome, where the credit amount stored in the memory is increased based on the provided awards associated with the second game outcome.

18. The gaming device of claim 17, where the modified version of the multi-reel symbol includes a multiplier associated with the multi-reel symbol.

19. The gaming device of claim 17, where the secondary reel further includes a multi-reel wild symbol associated with a multiplier.

20. The gaming device of claim 17, where the secondary reel further includes a multi-reel wild symbol associated with a movement direction indicator.

* * * * *